US009033436B2

(12) United States Patent
Holzapfel et al.

(10) Patent No.: US 9,033,436 B2
(45) Date of Patent: May 19, 2015

(54) FASTENING DEVICE FOR MOUNTING A FRONT COVER ON A DRAWER

(71) Applicant: Julius Blum GmbH, Hochst (AT)

(72) Inventors: Andreas Holzapfel, Bregenz (AT); Benjamin Hoffmann, Dornbirn (AT)

(73) Assignee: JULIUS BLUM GMBH, Hochst (AT)

( * ) Notice: Subject to any disclaimer, the term of this patent is extended or adjusted under 35 U.S.C. 154(b) by 0 days.

(21) Appl. No.: 14/083,898

(22) Filed: Nov. 19, 2013

(65) Prior Publication Data

US 2014/0077677 A1 Mar. 20, 2014

Related U.S. Application Data

(63) Continuation of application No. PCT/AT2012/000140, filed on May 22, 2012.

(30) Foreign Application Priority Data

May 24, 2011 (AT) ..... A 749/2011

(51) Int. Cl.
*A47B 88/00* (2006.01)

(52) U.S. Cl.
CPC ..... *A47B 88/0055* (2013.01); *Y10T 403/602* (2015.01); *A47B 88/0051* (2013.01)

(58) Field of Classification Search
CPC ..... A47B 88/0055; A47B 2088/0059; A47B 2088/0062; A47B 2088/0007; A47B 2088/0074
USPC ..... 312/334.4, 348.1, 348.2, 348.4, 263, 312/265.5
See application file for complete search history.

(56) References Cited

U.S. PATENT DOCUMENTS

| | | | | | |
|---|---|---|---|---|---|
| 4,874,212 | A | * | 10/1989 | Rock et al. | 312/330.1 |
| 5,466,061 | A | * | 11/1995 | Lautenschlager | 312/348.2 |
| 5,540,515 | A | * | 7/1996 | Rock et al. | 403/322.4 |
| 5,664,857 | A | * | 9/1997 | Lautenschlager et al. | 312/348.4 |
| 5,860,718 | A | * | 1/1999 | Brustle | 312/348.2 |

(Continued)

FOREIGN PATENT DOCUMENTS

| | | |
|---|---|---|
| AT | 006 773 | 4/2004 |
| CN | 101181116 | 5/2008 |

(Continued)

OTHER PUBLICATIONS

International Search Report (ISR) issued Sep. 13, 2012 in International (PCT) Application No. PCT/AT2012/000140.

(Continued)

*Primary Examiner* — Hanh V Tran
(74) *Attorney, Agent, or Firm* — Wenderoth, Lind & Ponack, L.L.P.

(57) ABSTRACT

A fastening device for releasably mounting a front cover on a drawer, in particular on a side wall of the drawer, includes a furniture fitting preassembled on the front cover; a catching mechanism associated with the drawer and which automatically retains the furniture fitting when the furniture fitting is inserted. The fastening device also includes a movable catching element having a positioning contour; and a locking mechanism for the catching mechanism. The locking mechanism prevents the furniture fitting from being accidentally released from the catching mechanism, and is equipped with a positioning member which can move within a guide track and rests against the positioning contour of the catching element.

19 Claims, 14 Drawing Sheets

(56) References Cited

U.S. PATENT DOCUMENTS

| | | | | |
|---|---|---|---|---|
| 5,971,516 | A * | 10/1999 | Huber | 312/348.1 |
| 6,027,194 | A * | 2/2000 | Fleisch | 312/348.4 |
| 6,412,893 | B1 * | 7/2002 | Muterthies et al. | 312/348.1 |
| 6,457,791 | B1 * | 10/2002 | Muterthies et al. | 312/348.4 |
| 7,055,919 | B2 * | 6/2006 | Lam Harn et al. | 312/348.4 |
| 8,220,885 | B2 * | 7/2012 | Weber | 312/348.4 |
| 8,297,724 | B2 | 10/2012 | Hammerle | |
| 2004/0000852 | A1 * | 1/2004 | Lam Harn et al. | 312/348.4 |
| 2005/0017615 | A1 * | 1/2005 | Salice | 312/348.4 |
| 2007/0138924 | A1 * | 6/2007 | Lautenschlager | 312/348.2 |
| 2007/0228906 | A1 * | 10/2007 | Netzer | 312/348.4 |
| 2009/0174299 | A1 * | 7/2009 | Lam et al. | 312/348.4 |
| 2010/0102692 | A1 * | 4/2010 | Hammerle | 312/348.4 |

FOREIGN PATENT DOCUMENTS

| | | | | |
|---|---|---|---|---|
| DE | 195 31 698 | 3/1997 | | |
| DE | 10 2007 053 637 | 5/2009 | | |
| DE | 20 2009 014 811 | 3/2010 | | |
| EP | 0 702 915 | 3/1996 | | |
| EP | 0 740 917 | 11/1996 | | |
| EP | 1 297 765 | 4/2003 | | |
| GB | 2182546 | A * | 5/1987 | A47B 88/00 |
| WO | 2009/006651 | 1/2009 | | |
| WO | 2009/059652 | 5/2009 | | |
| WO | 2010/115346 | 10/2010 | | |

OTHER PUBLICATIONS

Austrian Patent Office Search Report (ASR) issued Feb. 14, 2012 in Austrian Patent Application No. A 749/2011.

Chinese Search Report issued Jan. 5, 2015 in parallel Chinese Patent Application No. 201280025137.1.

* cited by examiner

FASTENING DEVICE FOR MOUNTING A FRONT COVER ON A DRAWER

BACKGROUND OF THE INVENTION

The invention concerns a fastening device for releasably fastening a front panel to a drawer, in particular to a drawer side wall. In particular, the fastening device includes at least one furniture fitting pre-mounted to the front panel, and a catching device associated with the drawer. The catching device automatically holds the furniture fitting when it is pushed in, and the catching device has a moveable catching element having a control contour. A locking device for the catching device prevents unintentional release of the furniture fitting from the catching device.

The invention further concerns a drawer having at least one such fastening device for releasably fastening a front panel to the drawer and also an article of furniture having such a drawer or drawers.

Fastening devices for releasably fastening the front panel to the drawer are already known from the state of the art. An aim in that respect is generally inter alia to provide for rapid fitment of the front panel to the drawer in order to keep down both the assembly times and also the assembly costs.

Thus, for example, WO 2009/006651 dated Jan. 15, 2009 shows a drawer side wall having a fastening device for releasably and preferably adjustably fastening a front panel to the drawer side wall. A furniture fitting is pre-mounted to the front panel, and arranged in the drawer side wall is a spring-loaded catching element which, when the furniture fitting is introduced, automatically pulls it towards the drawer side wall. A locking device is provided for the catching element, and the locking device is in the form of a clamping device.

EP 0 740 917 B1 dated Nov. 25, 1998, shows a device for fastening the front panel of a drawer to preferably double-wall drawer side walls. This device includes a furniture fitting which is fastened to the front panel and which projects therefrom, and a carrier portion which is associated with a drawer side wall and which carries a moveable arresting portion and which bears therewith entirely behind the front end edge of the drawer side wall. The arresting portion which couples the furniture fitting to the carrier portion is acted upon by a spring, and the arresting portion is in the form of a tilt lever which is rotatable about a horizontal axis. When the furniture fitting is pushed in automatically, the tilt lever latches under the spring force and pulls the furniture fitting towards the carrier portion. The tilt lever has a lateral receiving means for a screwdriver or the like with which it is rotatable out of the arresting position, against the spring action, thus releasing the furniture fitting.

DE 20 2009 014 811 U1 dated Mar. 25, 2010 discloses a furniture fitting for releasably connecting a first furniture part to a second furniture part. This fitting has a receiving element and at least two fastening elements. The receiving element is associated with the first furniture part, and the at least two fastening elements are associated with the second furniture part, or vice-versa. The receiving element has an arresting device for releasably holding the at least two fastening elements, and the at least two fastening elements can be jointly arrested in the receiving element. The arresting device of the receiving element has at least two arresting elements which are or can be acted upon by a force storage means, preferably a spring, and which are latchable to the fastening elements.

SUMMARY OF THE INVENTION

The object of the invention is to provide a fastening device for releasably fastening a front panel to the drawer, which device is improved over the state of the art.

By virtue of a control body which is moveable in a guide path and which bears against the control contour of the catching element, that moveable control body, when the furniture fitting is pushed in, can move automatically—for example due to gravity—in the guide path and slide along the control contour. Thus, a locking action can be achieved as an opposite movement of the furniture fitting (that is to say pulling it out) by the catching element that the moveable control body is jammed between the guide path and the control contour.

Even after jamming has occurred, however, the furniture fitting can be still further pushed into the fastening device, that is to say jamming is effected only in one direction. It is always still possible for the furniture fitting to be further pushed in, but it cannot be pulled out, as the moveable control body would jam with the control contour of the catching element when the attempt is made to pull it out.

It has proven to be particularly advantageous if the catching element is mounted pivotably about an axis of rotation. The catching element can follow the furniture fitting during the pushing-in movement, by virtue of the pivotal movement about the axis of rotation of the catching element.

In a preferred embodiment, the control contour of the catching element has different radial spacings relative to the axis of rotation of the catching element. The provision of different radial spacings of the control contour relative to the axis of rotation of the catching element makes it possible to provide for locking of the furniture fitting exclusively in the pulling-out direction and not in the pushing-in direction of the furniture fitting.

Further preferably, the control body is mounted positively guidedly displaceably in the—preferably curved—guide path.

It has proven to be particularly advantageous if the control body is in the form of a loose pressure roller and/or in one piece and/or substantially bolt-shaped and/or made from steel. Specifically, by virtue of the control body being in the form of a loose pressure roller, it can be easily moved in the guide path and it can even automatically move itself—as it is a loose roller—in the guide path. The structure made of steel can provide for particularly preferred strength for the control body. The one-piece and bolt-form configuration can also be preferable in terms of production engineering.

Particularly preferably, the guide path can be at least partially of a curved configuration with a—preferably continuously—decreasing radius. A curved configuration for the guide path means that it is possible to positively influence the pushing-in characteristics and the ejection characteristics of the fastening device in interacting mode with the furniture fitting.

In that respect, it has proven to be particularly advantageous if the fastening device has a feed path for the furniture fitting, wherein the feed path is of a substantially straight configuration, and the locking device automatically holds the furniture fitting against unintentional release at at least two different positions on the feed path. By virtue of the provision of a feed path having a substantially straight configuration, the furniture fitting can be relatively easily fitted on that feed path and pushed thereon, which can contribute to a mode of operation that is to be preferred. In addition, the furniture fitting can remain locked in a first position in the pull-out direction on that feed path on the one hand, while on the other hand it can also be further pushed in and can remain locked at a second position.

In a preferred embodiment, the locking device can hold the furniture fitting against unintentional release at least region-wise on any positions on the feed path. The furniture fitting can thus be locked in the fastening device—independently of the depth of insertion of the furniture fitting in the fastening device.

It has further proven to be advantageous if the fastening device has a pull-in device for the furniture fitting, wherein the pull-in device has a pivotal lever which is loaded by a spring and which displaces the moveable control body in the guide path, pivots the catching element and pulls the furniture fitting under a spring loading towards the drawer. The provision of a spring-loaded pivotal lever which displaces the moveable control body in the guide path makes it possible to achieve automatic retraction of the furniture fitting by pulling it in towards the drawer.

It has proven to be advantageous if the fastening device has an unlocking device for the catching device, which permits intentional release of the furniture fitting from the catching device. The unlocking device lifts the control body off the control contour of the catching element and thereby releases the catching element and the furniture fitting. By virtue of the provision of an unlocking device, the furniture fitting can be unlocked from the fastening device again and can subsequently be removed from that fastening device.

Preferably, the unlocking device can have an ejector which permits ejection of the unlocked furniture fitting, and the ejector pivots the unlocked catching element and thereby repels the furniture fitting from the drawer. Because the unlocking device has an ejector, the furniture fitting does not have to be pulled out of the fastening device but the movement of the furniture fitting out of same can be actively effected by the ejector of the unlocking device.

In a possible embodiment, the unlocking device can have a tool receiving means for a tool, which is accessible from the exterior and by way of which the unlocking device and/or the ejector is actuable. The unlocking device can be easily actuated by the provision of an externally accessible tool receiving means.

In a preferred embodiment, the fastening device can have a height adjusting device and/or a lateral adjusting device for the front panel. The front panel can be adjusted in height relative to the drawer by the provision of a height adjusting device for the fastening device, while the front panel can be laterally oriented relative to the drawer by the provision of a lateral adjusting device for the front panel.

Protection is also claimed for a drawer having at least one fastening device for releasably fastening a front panel to the drawer in accordance with at least one of the described embodiments.

Protection is also specifically claimed for an article of furniture having a drawer as described.

BRIEF DESCRIPTION OF THE DRAWINGS

Further details and advantages of the present invention are described more fully hereinafter by the specific description with reference to the embodiments by way of example illustrated in the drawings in which:

FIG. 6 is a side view of the fastening device with the furniture fitting locked and the furniture fitting not entirely pushed in, FIG. 7 is a side view of the fastening device with the furniture fitting automatically pulled in.

DETAILED DESCRIPTION OF THE INVENTION

Figure 1B:
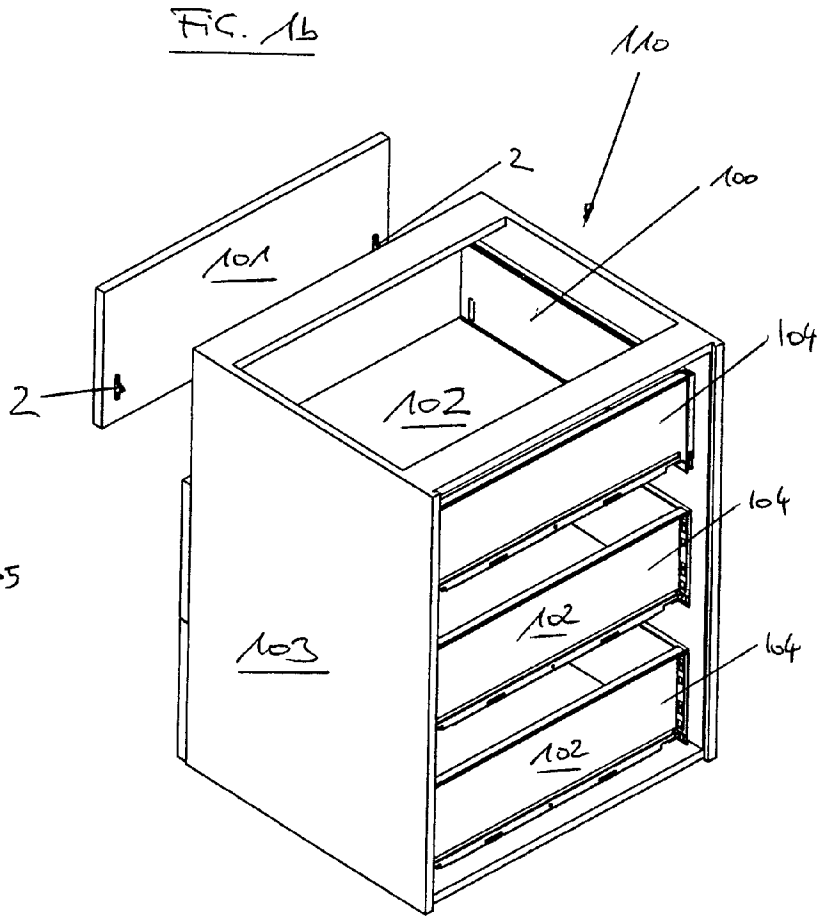
FIG. 1*b* is a perspective rear view of an article of furniture with drawers.

The following specific description of FIGS. 3*a* through 10 refers to a large number of devices and units which often have components which are used by a plurality of such devices. To give an overview of the components of the different devices that are described in this preferred embodiment, reference is to be made to the following list:

The components of the catching device 10 that are essential for operation thereof are:

the catching element 11
the axis of rotation A of the catching element 11
the receiving portion 13 of the catching element 11
the feed path 6.

The components of the locking device 20 that are essential for operation thereof are:

the control body 4 or the pressure roller 5
the guide path 3
the control contour 12
the catching element 11
the axis of rotation A of the catching element 11.

The components of the pull-in device 30 that are essential for operation thereof are:

the pivotal lever 31
the axis of rotation B of the pivotal lever 31
the guide 33 of the pivotal lever 31
the spring 32
the thrust element 34
the control body 4 or the pressure roller 5
the control contour 12
the catching element 11
the guide path 3.

The components of the unlocking device 40 that are essential for operation thereof are:

the unlocking element 43 of the pivotal lever 31
the guide 33 of the pivotal lever 31
the control body 4 or the pressure roller 5
the guide path 3
the ejector 41.

All the devices 10, 20, 30 and 40 just mentioned above are provided in a compact structure on the main plate 73 of the fastening device 1 and are displaced together with the main plate 73 vertically by the height adjusting device 50 and horizontally by the lateral adjusting device 60.

Figure 1A:
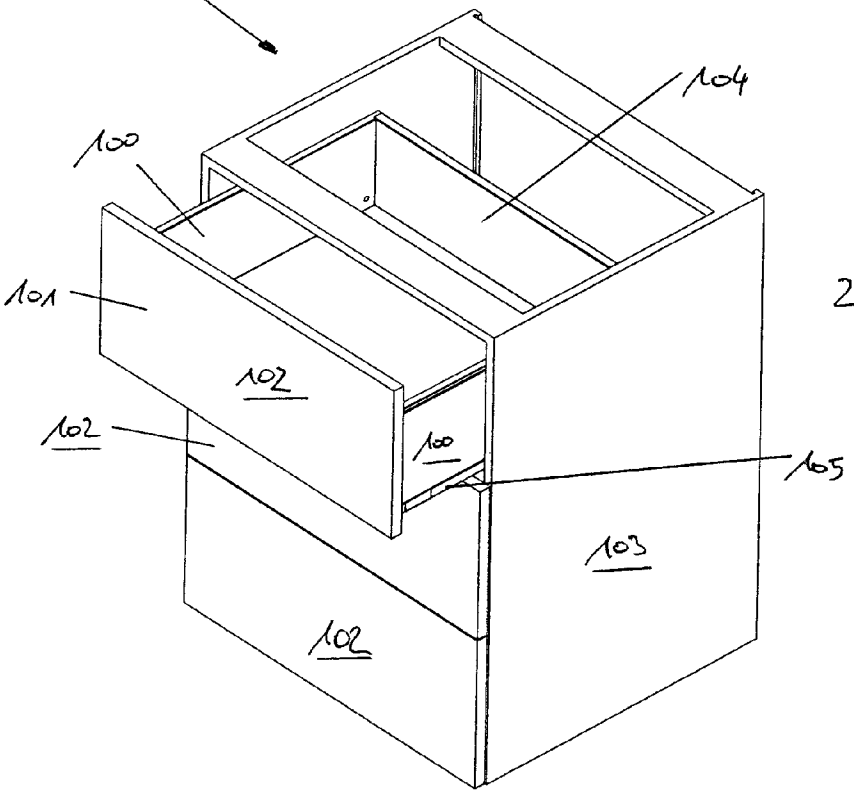
FIG. 1*a* is a perspective front view of an article of furniture with drawers.

FIG. 1*a* shows a perspective front side view of an article of furniture 110. That article of furniture 110 has three drawers 102 in a furniture carcass 103. The drawers 102 are mounted moveably in the furniture carcass 103 on a drawer extension guide 105, and each has two drawer side walls 100, a front panel 101 and a drawer rear wall 104. The front panel 101 is fixed to the two side walls 100 of the drawer 102 by way of the fastening devices 1 (not shown here: see FIG. 2).

FIG. 1*b* shows a perspective side rear view of an article of furniture 110 with again three drawers 102, as just shown in FIG. 1*a*. The front panel 101 is not yet fitted to the uppermost drawer 102. For that reason, the two furniture fittings 2 can be seen, by way of which a connection is made to the drawer side walls 100.

Figure 2A:
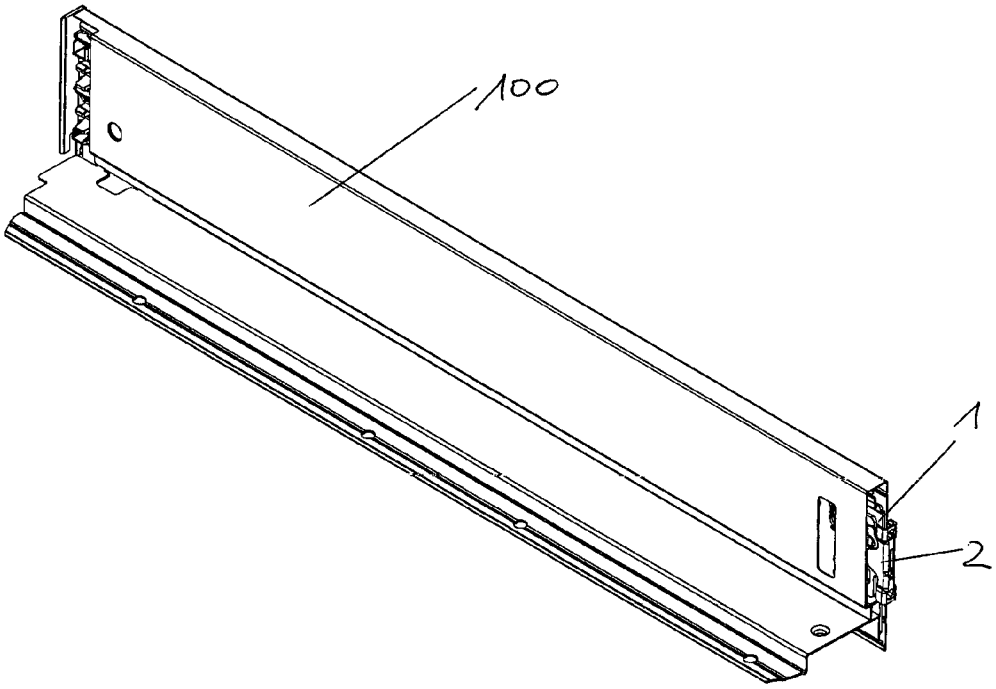
FIG. 2*a* is a perspective view of a drawer side wall with a fastening device and a furniture fitting.
Figure 2B:
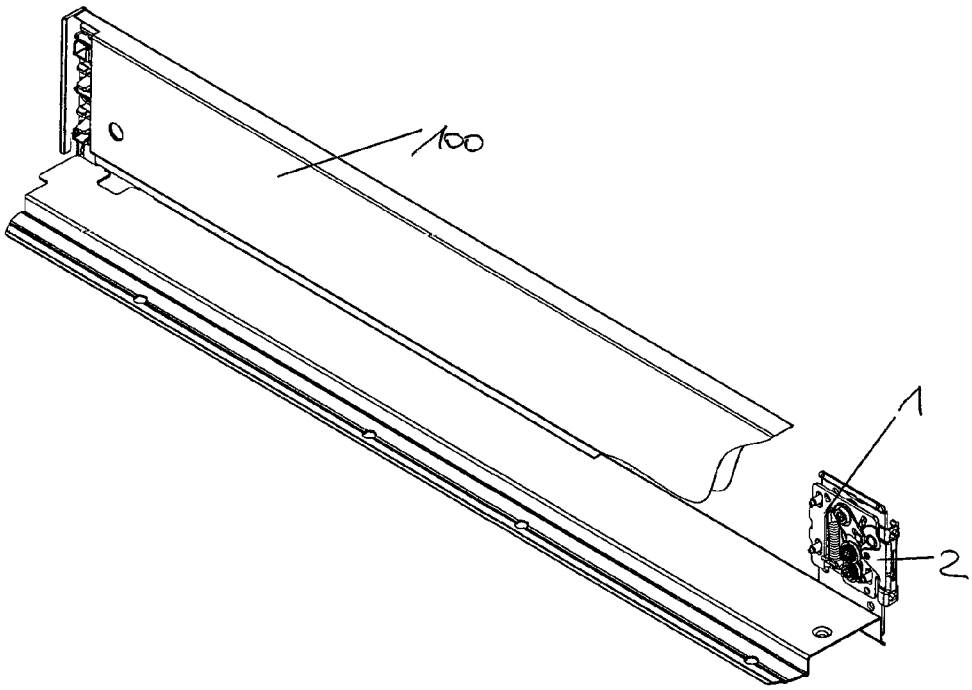
FIG. 2*b* is a perspective side view of a drawer side wall with a cut-out at the fastening device.

FIG. 2*a* shows a perspective view of a right-hand drawer side wall 100 of an article of furniture 110 (not shown here: see FIG. 1*a* or 1*b*). The fastening device 1 for a front panel 101 (not shown here) can be seen at the front end of the drawer side wall 100 in this preferred embodiment, in the drawer side wall 100. The furniture fitting 2 of the front panel 101 (not shown here) is already latched in the fastening device 1, as can be clearly seen from FIG. 2*b*.

It will be appreciated that the fastening device 1 could equally not be provided on the drawer side wall 100, but also on any other part of the drawer 102 (not shown).

Figure 3A:
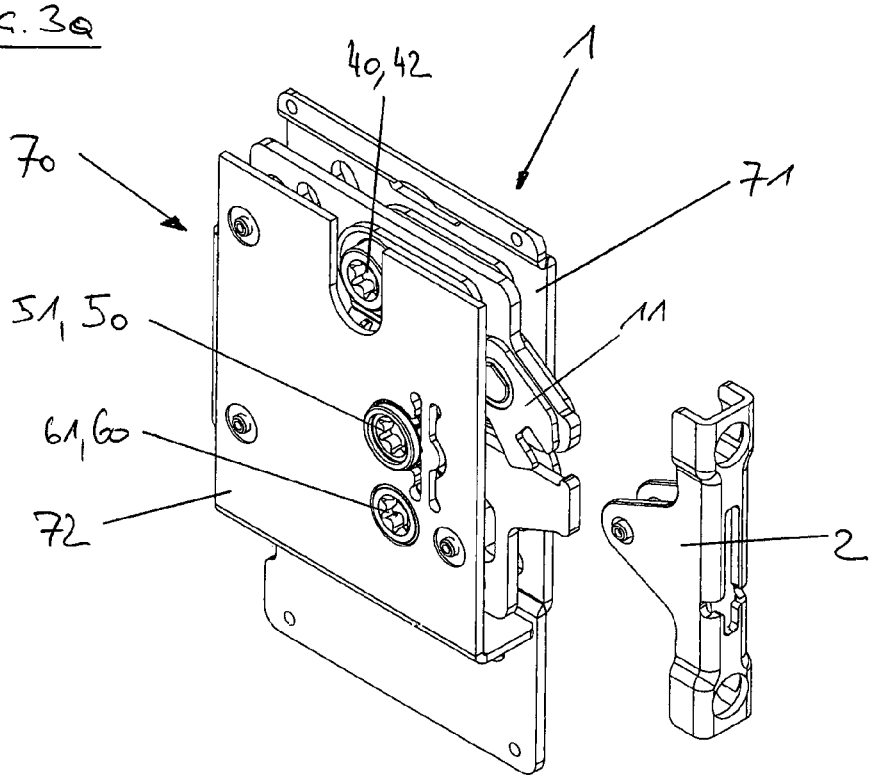
FIG. 3*a* is a perspective side view of a fastening device in its housing.

FIG. 3*a* shows a perspective side view of a fastening device 1 and the furniture fitting 2 to be fastened thereto. The fastening device 1 has a housing 70 with a right-hand side cover 71 and a left-hand side cover 72. At the left-hand side cover 72, it is possible to see the adjusting elements for the height adjusting device 50 (its height adjusting screw 51), for the lateral adjusting device 60 (its lateral adjusting screw 61) and for the unlocking device 40 (or its tool receiving portion 42).

Figure 3B:
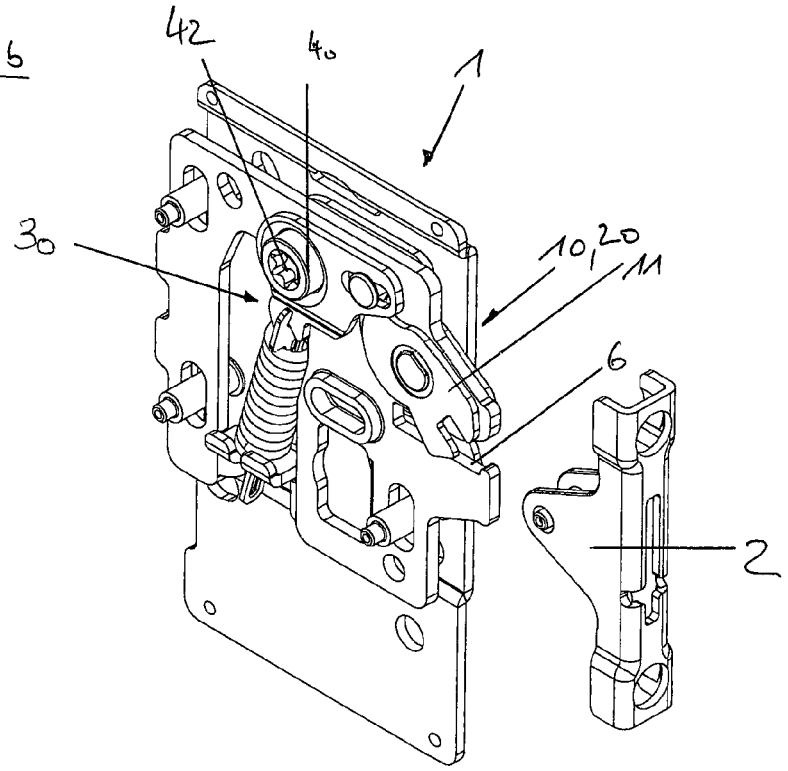
FIG. 3*b* is a perspective side view as in FIG. 3*a* without housing.

FIG. 3*b* shows a perspective side view of a fastening device 1, as just described with reference to FIG. 3*a*, without the left-hand side cover 72. The height adjusting device 50 and the lateral adjusting device 60 are also not shown here.

Figure 6:
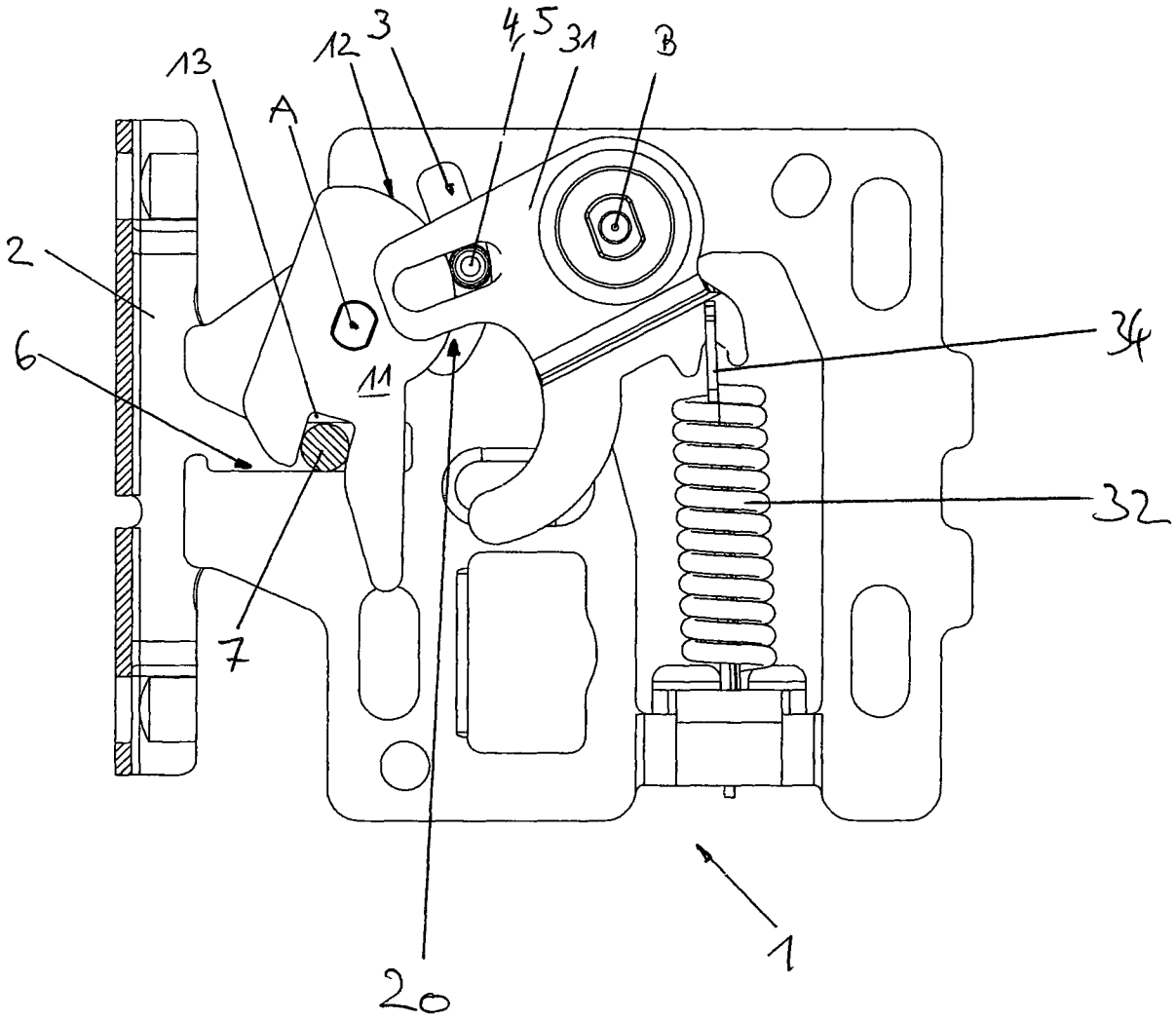

This view clearly shows the catching device 10 and its catching element 11 serving to catch the furniture fitting 2 on the feed path 6 and to lock the furniture fitting 2 to the fastening device 1, for which the locking device 20 is provided (see in that respect the specific description of FIG. 6).

The fastening device 1 here also has the pull-in device 30 and also the unlocking device 40.

Figure 5A:
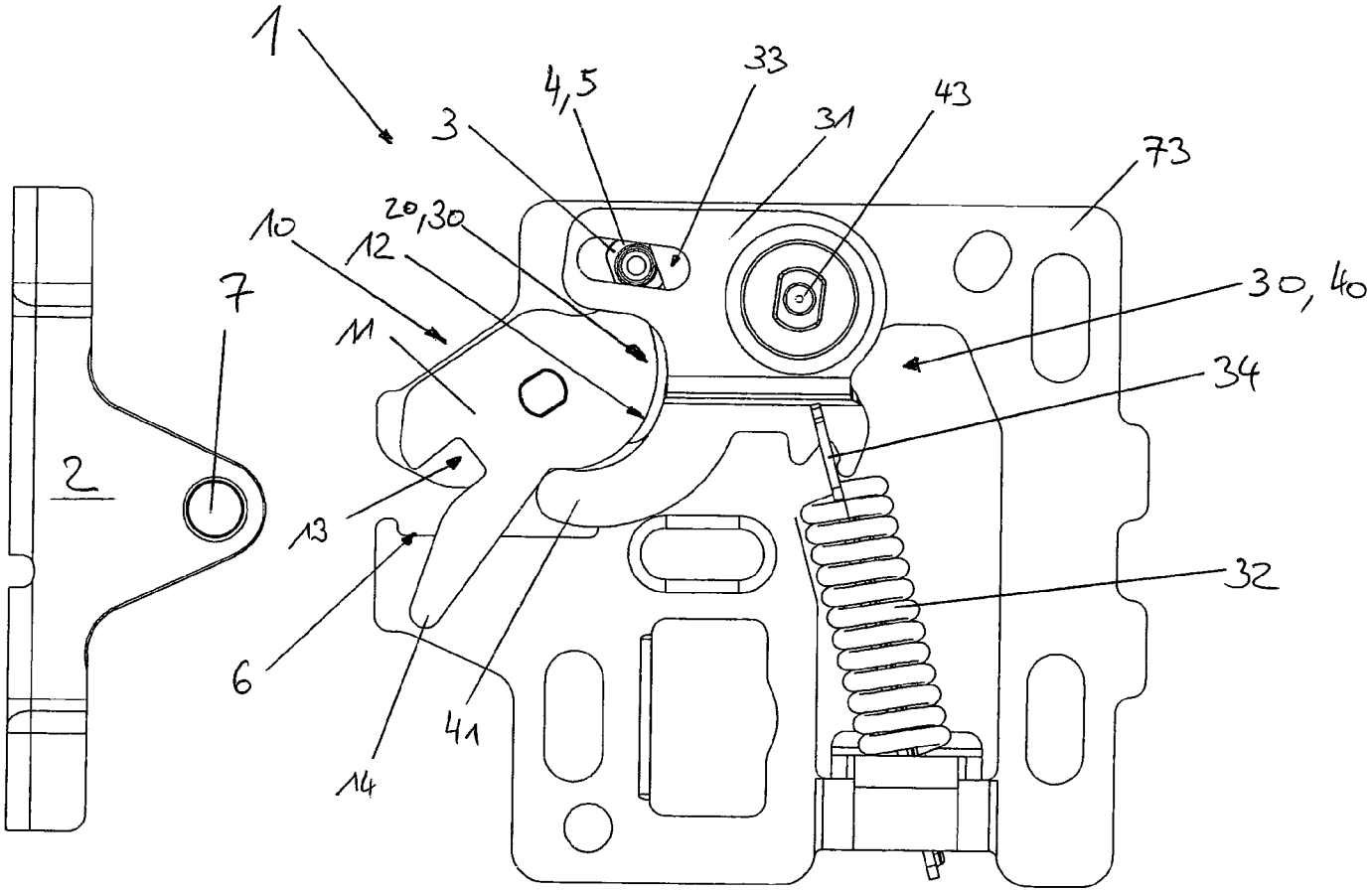
Figure 5B:
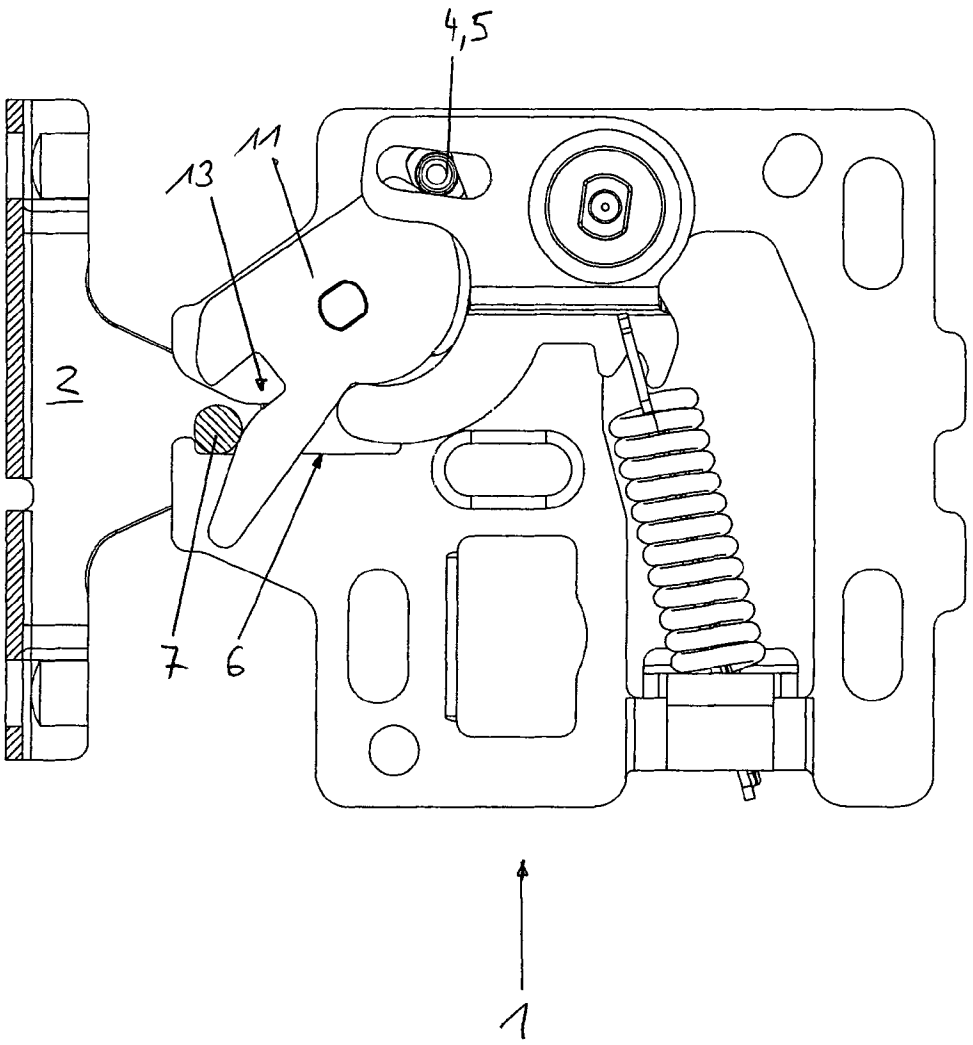
Figure 5C:
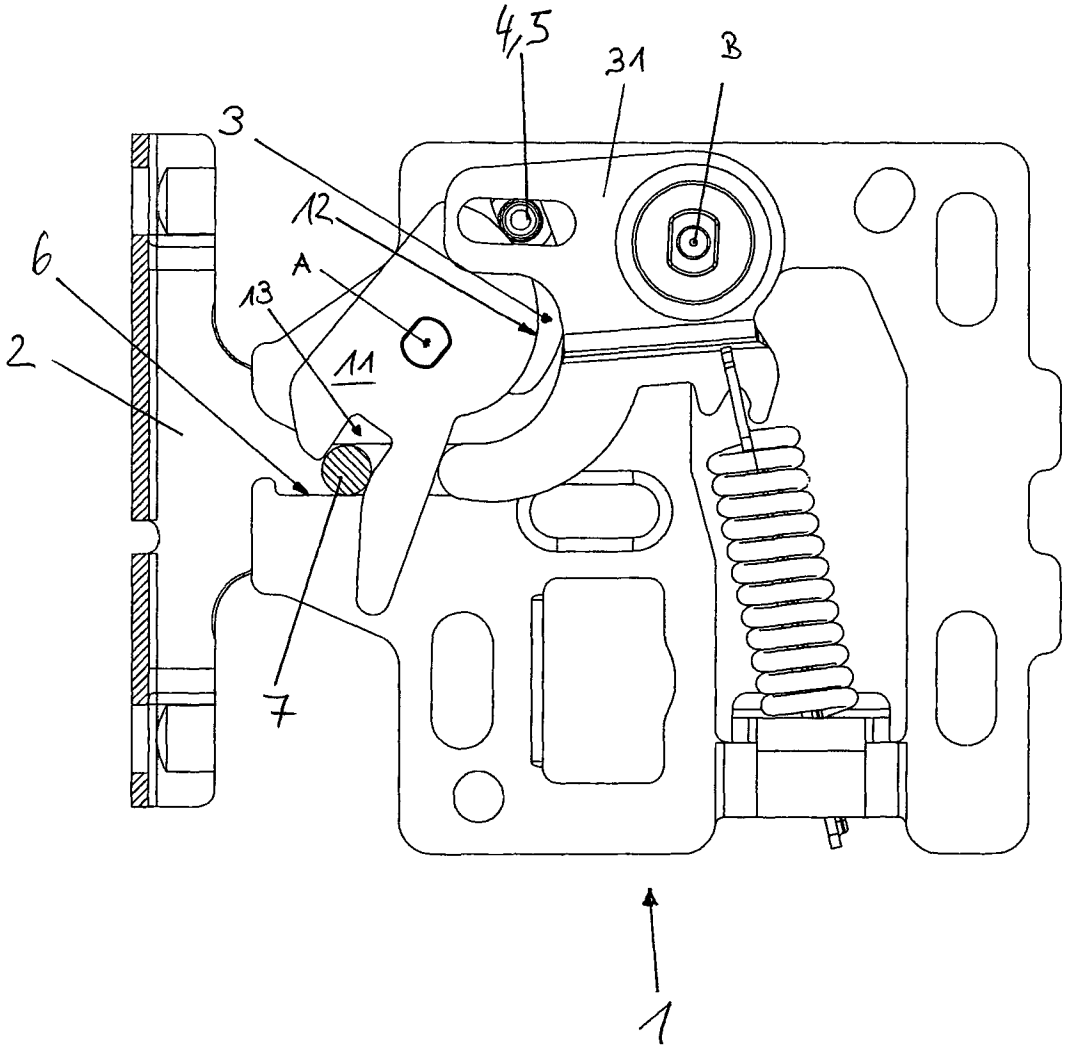
Figure 7:
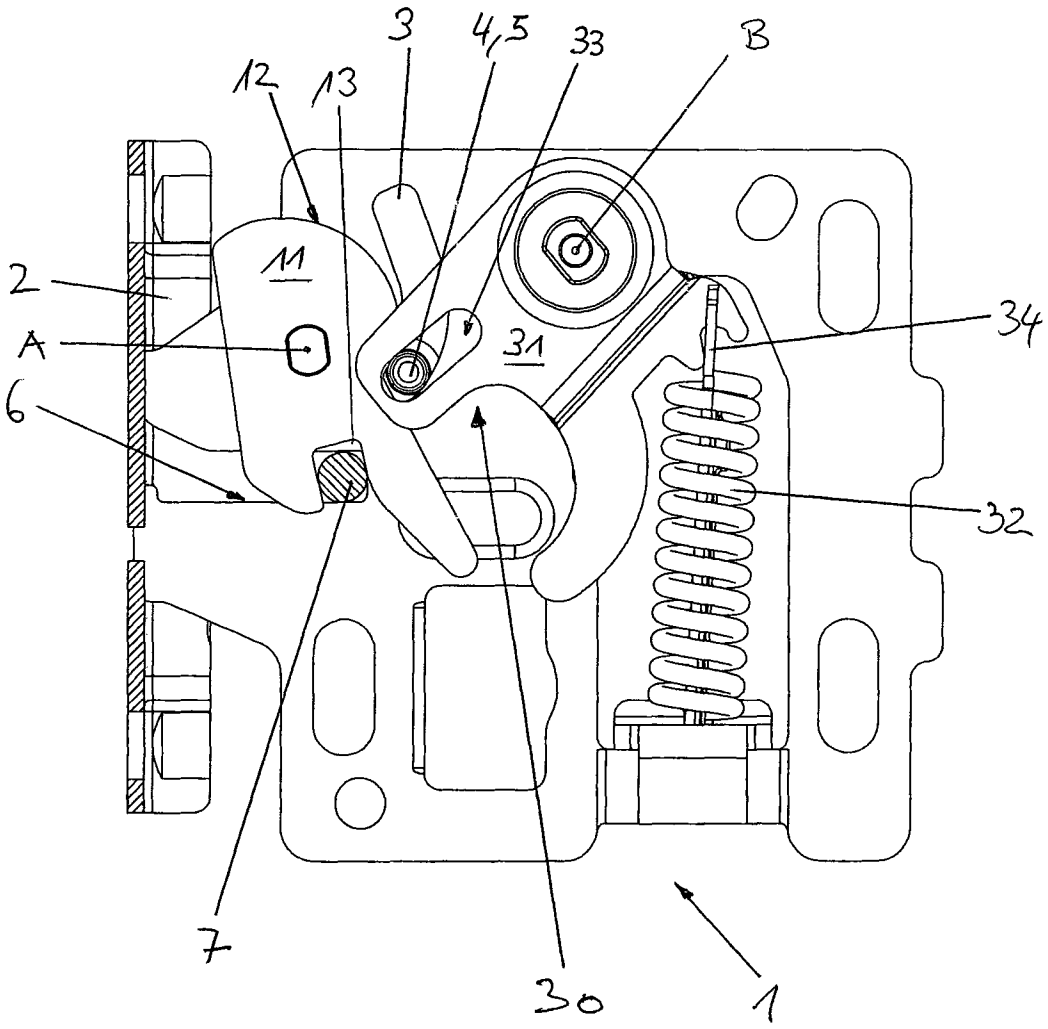
Figure 8:
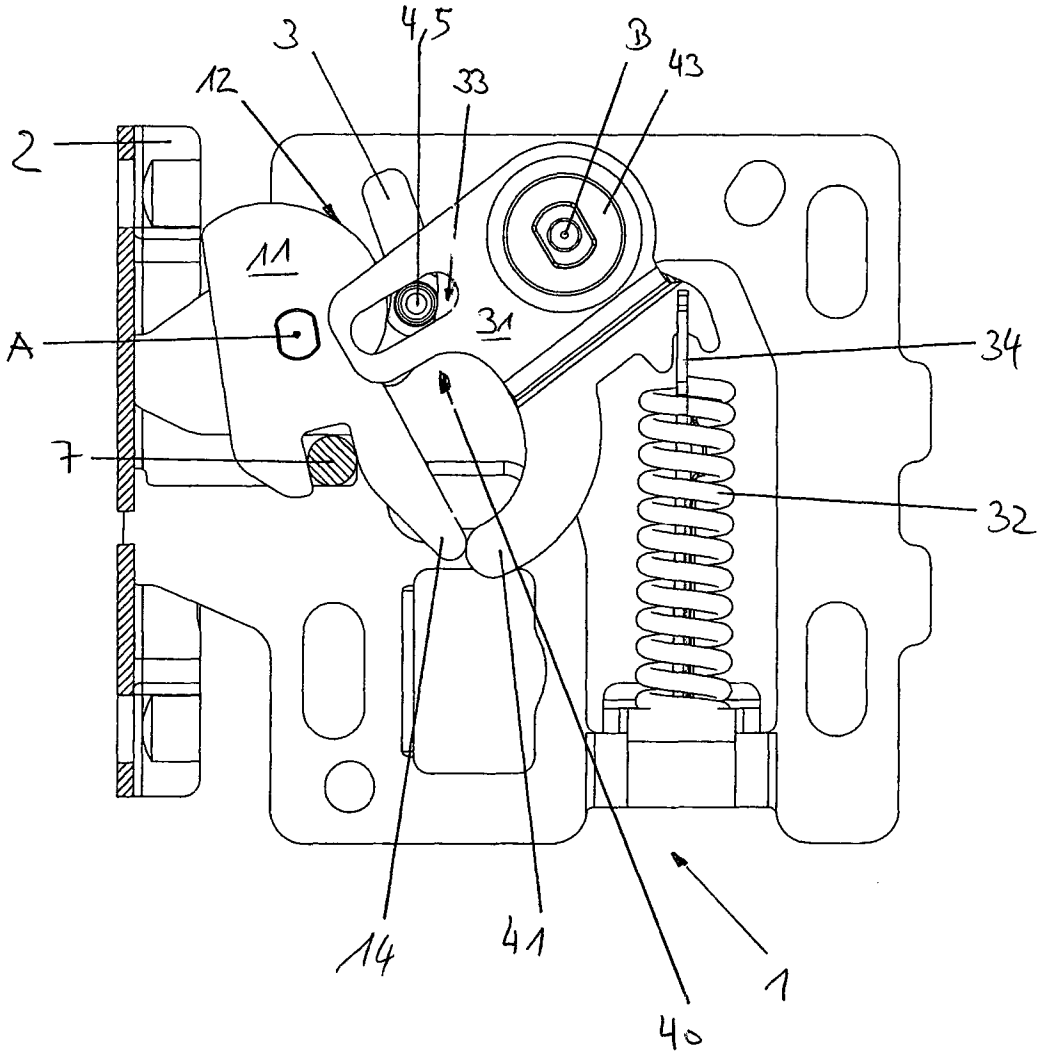
FIG. 8 is a side view of the fastening device with activated unlocking.
Figure 9A:
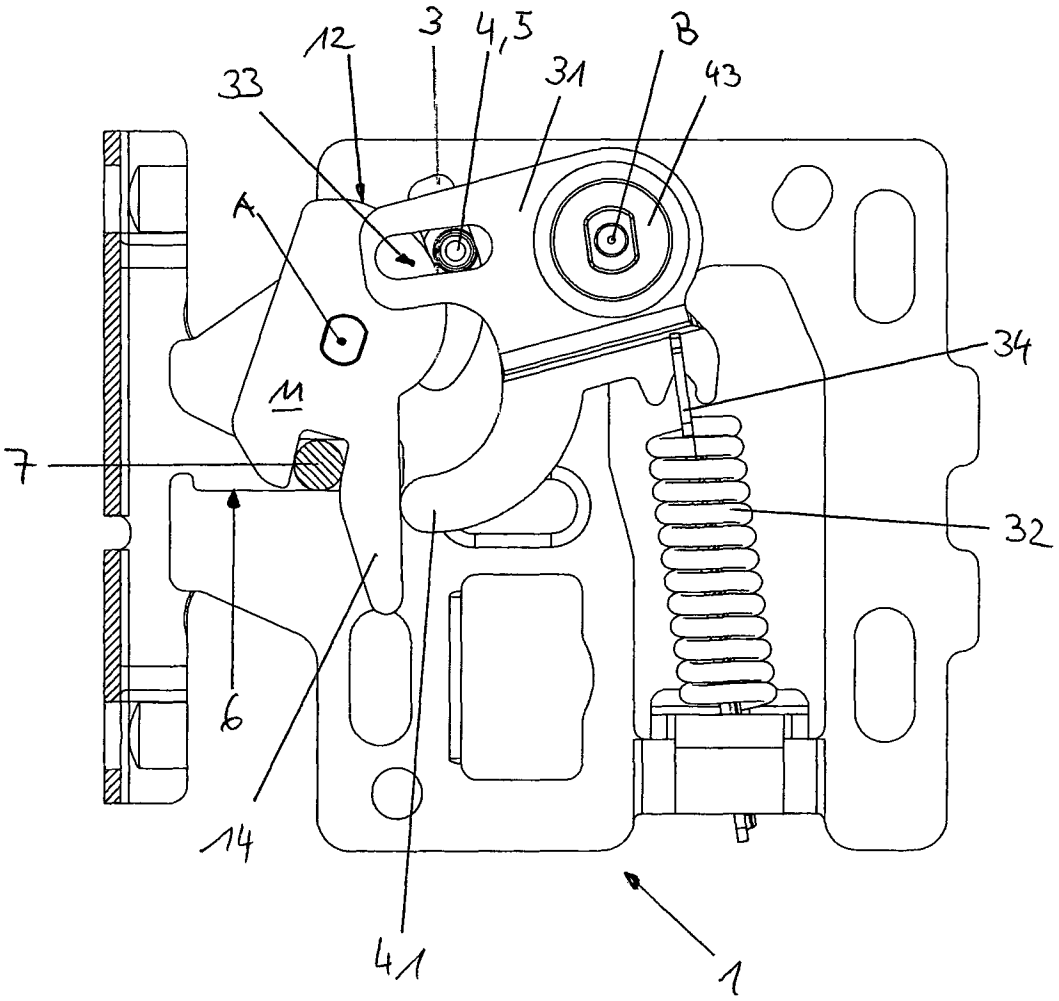
FIGS. 9*a* through 9*c* are side views of the fastening device with unlocked and ejected furniture fitting.
Figure 9B:
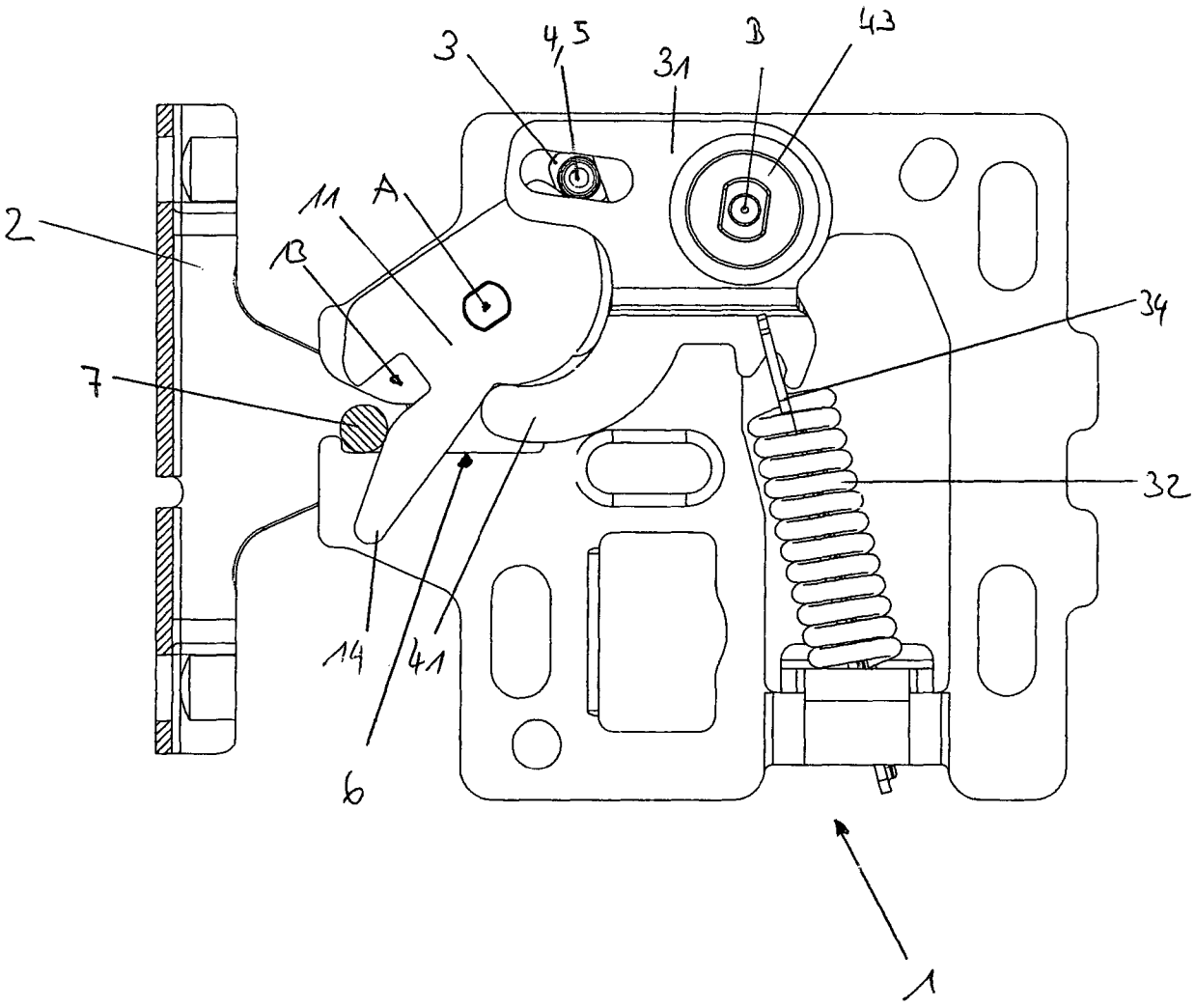
Figure 9C:
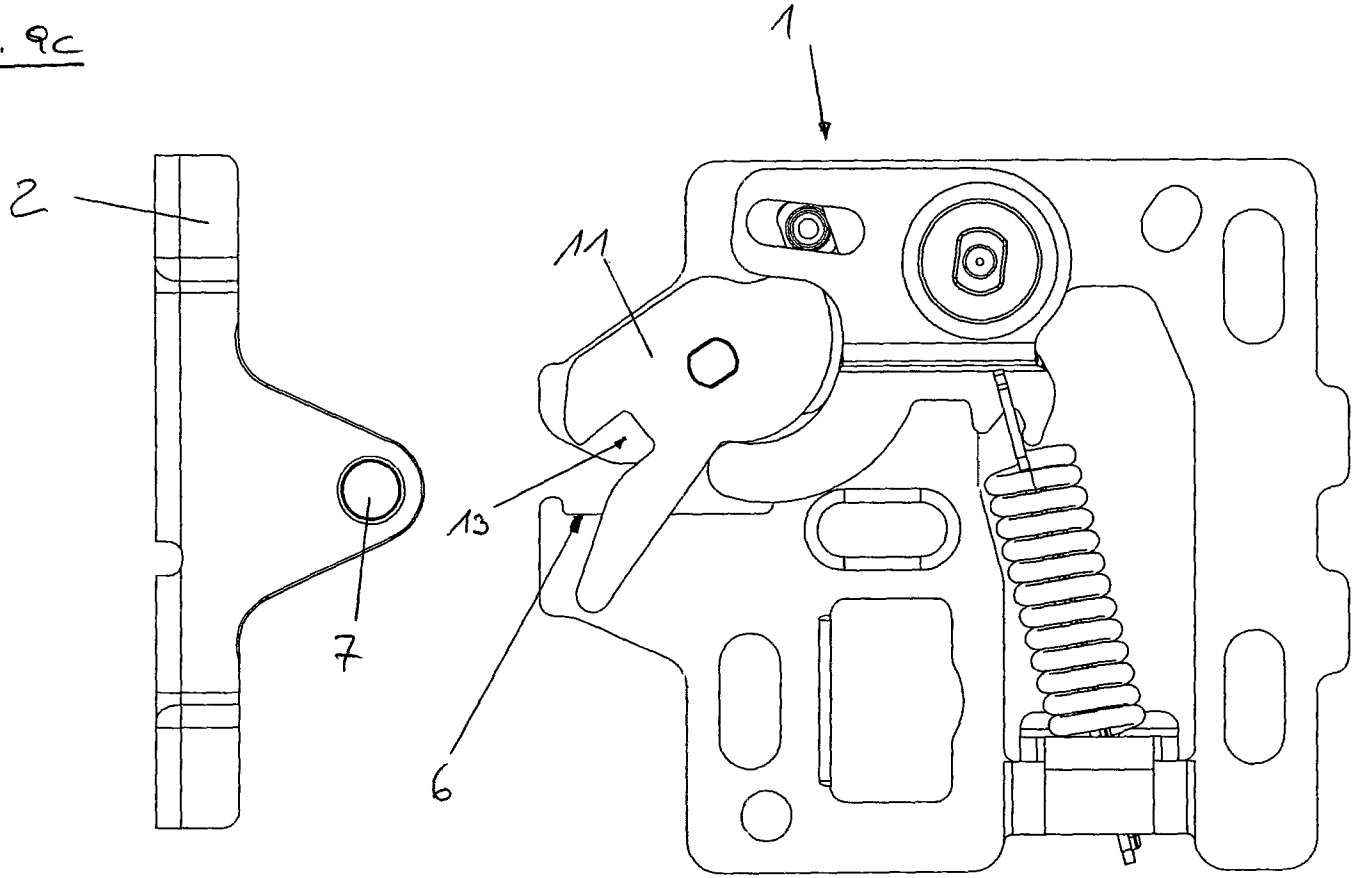

All the above-mentioned devices 10, 20, 30 and 40 and the operational movements thereof are described more precisely in detail in the following parts of the specific description:

catching device 10: FIGS. 5*a*, 5*b* and 5*c*
locking device 20: FIG. 6
pull-in device 30: FIG. 7
unlocking device 40: FIG. 8
ejection operation: FIGS. 9*a* through 9*c*

Figure 4:
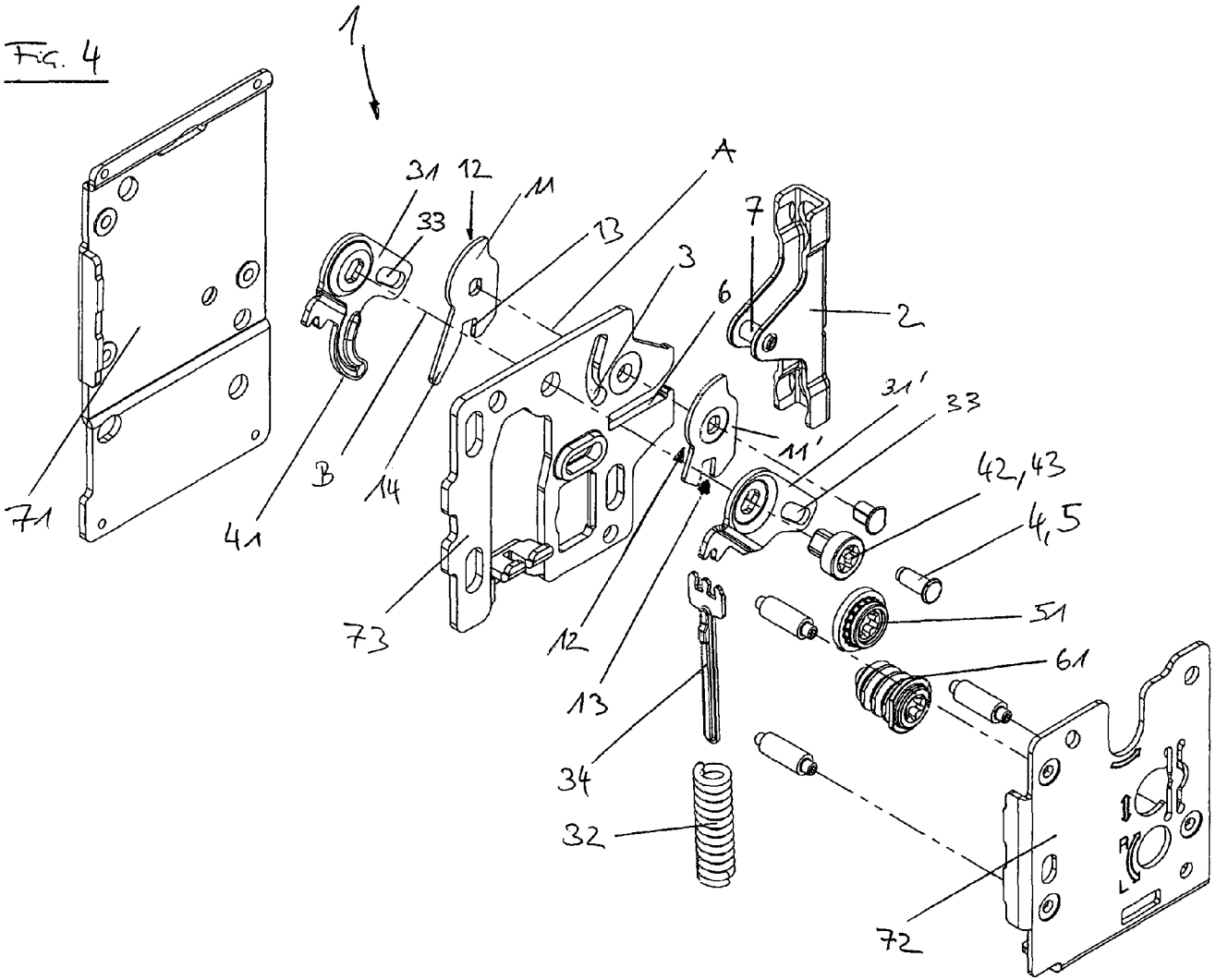
FIG. 4 is a perspective exploded view of a fastening device, FIGS. 5*a* through 5*c* ae side views of the fastening device in various stages during insertion and displacement of the furniture fitting.

FIG. 4 shows a perspective exploded view of the fastening device 1 for the furniture fitting 2 as a side rear view. The right-hand side cover 71 and the left-hand side cover 72 serve as a housing for the fastening device 1. Arranged between those two side covers 71 and 72 is the main plate 73 on which the essential components of the fastening device 1 are disposed. Main plate 73 is adjustable in height relative to the left-hand and right-hand side covers 71 and 72 by the height adjusting screw 51.

In this arrangement, the main plate 73 has a guide path 3 in which the movable control body 4—which in this preferred embodiment is in the form of a loose pressure roller 5—is displaceably mounted. The main plate 73 also has the feed path 6 for the pin 7 of the furniture fitting 2. The pin 7 of the furniture fitting 2 is introduced into the fastening device 1 along that feed path 6.

For stability reasons, the components that are essential for functioning—the catching element 11 and the pivotal lever 31—are each duplicated, wherein a respective one of the pair of these duplicated components is provided at the left and the right of the main plate 73.

The catching elements 11 and 11' each have a receiving portion 13 for receiving the pin 7 of the furniture fitting 2. The control contour 12 is also provided on both catching elements 11 and 11' in this preferred embodiment.

In addition, provided on the catching element 11 is the unlocking lever 14 for unlocking or ejecting the furniture fitting 2.

Formed on the pivotal levers 31 and 31' is the guide 33 which in this embodiment is in the form of an elongate hole. The pivotal lever 31 further has the ejector 41 which together with the unlocking lever 14 of the catching element 11 implements ejection of the furniture fitting 2. The pivotal lever 31 or 31' is actuated by way of the unlocking element 43 having a tool receiving portion 42.

The two pivotal levers 31 and 31' are spring-loaded by way of the spring 32 and its thrust element 34, this being necessary for the pulling-in movement of the furniture fitting 2 (see the specific description of FIG. 7).

The fastening device 1 can be laterally adjusted by way of the lateral adjusting screw 61.

FIGS. 5*a* through 9*c* each show a section through a side view of a fastening device 1 and a furniture fitting 2 in various situations. Those situations reflect the insertion of the furniture fitting 2 into the fastening device 1 (FIGS. 5*a* through 5*c*), locking of the furniture fitting 2 in the fastening device 1(FIG. 6), pulling in the furniture fitting 2 in the fastening device 1 (FIG. 7), unlocking of the furniture fitting 2 in the fastening device 1 (FIG. 8) and ejection of the furniture fitting 2 from the fastening device 1 (FIG. 9*a* through 9*c*).

For reasons of clarity, not all components of the fastening device 1 are always provided with references in the individual views in FIGS. 5*a* through 9*c*. The components which are crucial for the respective step and the references thereof are, however, included.

FIG. 5*a* shows the furniture fitting 2 and its pin 7, as it is not yet connected to the fastening device 1. The catching element 11 is "waiting" with its receiving portion 13 at the feed path 6 for the pin 7 of the furniture fitting 2. The control body 4 or pressure roller 5 is not or is not yet bearing against the control contour 12 of the catching element 11.

FIG. 5*b* shows the same situation as FIG. 5*a*, but now the pin 7 of the furniture fitting 2 has already been fitted into the feed path 6. However, rotation of the catching element 11 has not yet taken place. For that reason, the pressure roller 5 has also not yet moved.

FIG. 5*c* shows the fastening device 1 into which the furniture fitting 2 or its pin 7 has already been inserted. That insertion movement took place along the feed path 6. In this case, the pin 7 of the furniture fitting 2 has penetrated into the receiving portion 13 of the catching element 11. The catching element 11 is mounted pivotably about its axis of rotation A, and insertion of the pin 7 thus resulted in a rotational movement of the catching element 11 about the axis of rotation A. In this preferred embodiment, the control contour 12 is formed or mounted on the catching element 11. That control contour 12 of the catching element 11 involves different radial spacings relative to the axis of rotation A of the catching element 11. The control body 4, which in this preferred embodiment is in the form of a pressure roller, already bears at this time against the control contour 12. At this time, it would still be possible for the furniture fitting to be pulled out of the fastening device 1 as the control body 4 is not yet jammed to the control contour 12. It can still escape "upwardly" in the guide path 3, if rotation of the catching element 11 about the axis of rotation A in the clockwise direction should occur.

Locking of the catching element 11 and therewith the furniture fitting 2 only takes place in a situation as shown in FIG. 6. The furniture fitting 2 or its pin 7 has now been inserted into the fastening device 1 in the feed path 6 to such an extent that the locking device 20 was activated. That was achieved by clamping of the pressure roller 5 (control body 4) together with the control contour 12. If the attempt were made to pull the furniture fitting 2 out of the fastening device 1 and thus to pivot the catching element 11 about the axis of rotation A in the clockwise direction, the pressure roller 5 would be jammed in the guide path 3 by the control contour 12. The furniture fitting 2 is thus prevented from being pulled out.

On the other hand, it is still very well possible for the catching element 11 to be moved in the counter-clockwise direction about the axis of rotation A, which would result in a further downward movement of the control body 4 (pressure roller 5) in the preferably curved guide path 3.

In this respect, it should be noted that the pivotal lever 31 and its guide 33 are not necessary for the locking device 20. Locking of the catching element 11 is effected simply and solely by the control contour 12, the guide path 3, and the control body 4. That is possible because the control body 4 would follow the guide path 3 or the control contour 12 solely by virtue of gravity.

It is now possible to see here a great advantage of this locking device 20. More specifically, locking of the furniture fitting 2 is effected on the guide path 6 at any locations in the insertion directions. In other words, locking occurs independently of the depth of insertion of the furniture fitting 2 into the fastening device 1. Even after locking has occurred, further insertion of the furniture fitting 2 into the fastening device 1 is possible, that is to say locking is effected only in the pull-out direction but not in the push-in direction. It is therefore possible to achieve different insertion depths, whereby it is also possible to correct tolerances in manufacture in respect of the furniture fitting 2 or the drawer 102 (not shown).

In this preferred embodiment, the control body 4 is in the form of a loose pressure roller 5 both in one piece and also of substantially bolt-shaped configuration and made from steel.

The guide path 3 at least partially has a curved configuration with a—preferably continuously—decreasing radius.

FIG. 7 now shows how the pull-in device 30 becomes operational. After the furniture fitting 2 is pushed into the catching device 10 or its catching element 11 and displacement on the feed path 6, at the moment shown in FIG. 6 the spring 32 is no longer in the dead-center point position with the axis of rotation B of the pivotal lever 31 and thus pivots that pivotal lever 31 in the counter-clockwise direction about the axis of rotation B, as shown in FIG. 7.

The result of this is that the pressure roller 5 or the control body 4 is urged along the guide path 3 downwardly in the guide 33—which is in the form of an elongate hole—of the pivotal lever 31. That pressure downwardly means that the control body 4 moves downwardly under a spring loading in its guide path 3 and in that case—by virtue of the provision of the control contour 12 on the catching element 11—the catching element 11 is also pivoted in the counter-clockwise direction about its axis of rotation A. In that way, the furniture fitting 2 is pulled further into the fastening device 1 by that roller-control contour actuating assembly.

The pull-in characteristics can thus be controlled—by virtue of a suitable configuration of the control contour (slow or fast pulling-in movement, accelerated or decelerated pulling-in movement).

In this position, the locking device 20 is again or is always still active as the control body 4 still bears against the control contour 12 and would become jammed thereto, if the attempt were made to pivot the catching element 11 in the clockwise direction.

To unlock the fastening device 1 again there is provided the unlocking device 40, the functioning of which will now be described with reference to FIG. 8. Unlocking can be effected manually by way of the unlocking element 43 which is provided on the pivotal lever 31. Rotation of the pivotal lever 31 in the clockwise direction provides that the control body 4 in the guide 33 is lifted off the control contour 12 and thus the catching element 11, whereby the catching element 11 is no longer blocked.

The furniture fitting 2 could already be pulled out of the fastening device 1 at that moment. To make ejection more user-friendly, however, an ejector 41 is provided on the pivotal lever 31, which—as is already apparent in this view—presses against the unlocking lever 14 of the catching element 11 and thus rotation of the pivotal lever 31 in the clockwise direction leads to rotation of the catching element 11 in the clockwise direction, whereby the furniture fitting 2 is ejected from the fastening device 1, as is shown in FIG. 9*a*. It can be clearly seen in this respect that the control body 4 is always still lifted off the control contour 12 of the catching element 11 and the furniture fitting 2 has already moved a distance away from the fastening device 1, this having been effected by the displacement of the unlocking lever 14 by the ejector 41.

If at that moment the operator should release the unlocking lever 43, then that would involve the furniture fitting 2 being pulled in again—as is shown in FIG. 7.

If in contrast the operator further rotates the unlocking lever 43 in the clockwise direction then—as shown in FIG. 9—this involves complete ejection of the pin 7 of the furniture fitting 2 on the feed path 6.

The operator can release the unlocking element 43 again in that position as the spring 32 is disposed with its thrust element 34 in a dead-center point position relative to the axis of rotation B of the pivotal lever 31 and thus the control body 4 and the control contour 12 no longer bear against each other under a spring loading.

Thus the furniture fitting 2 can be removed from the fastening device 1, as shown in FIG. 9*c*.

Figure 10:
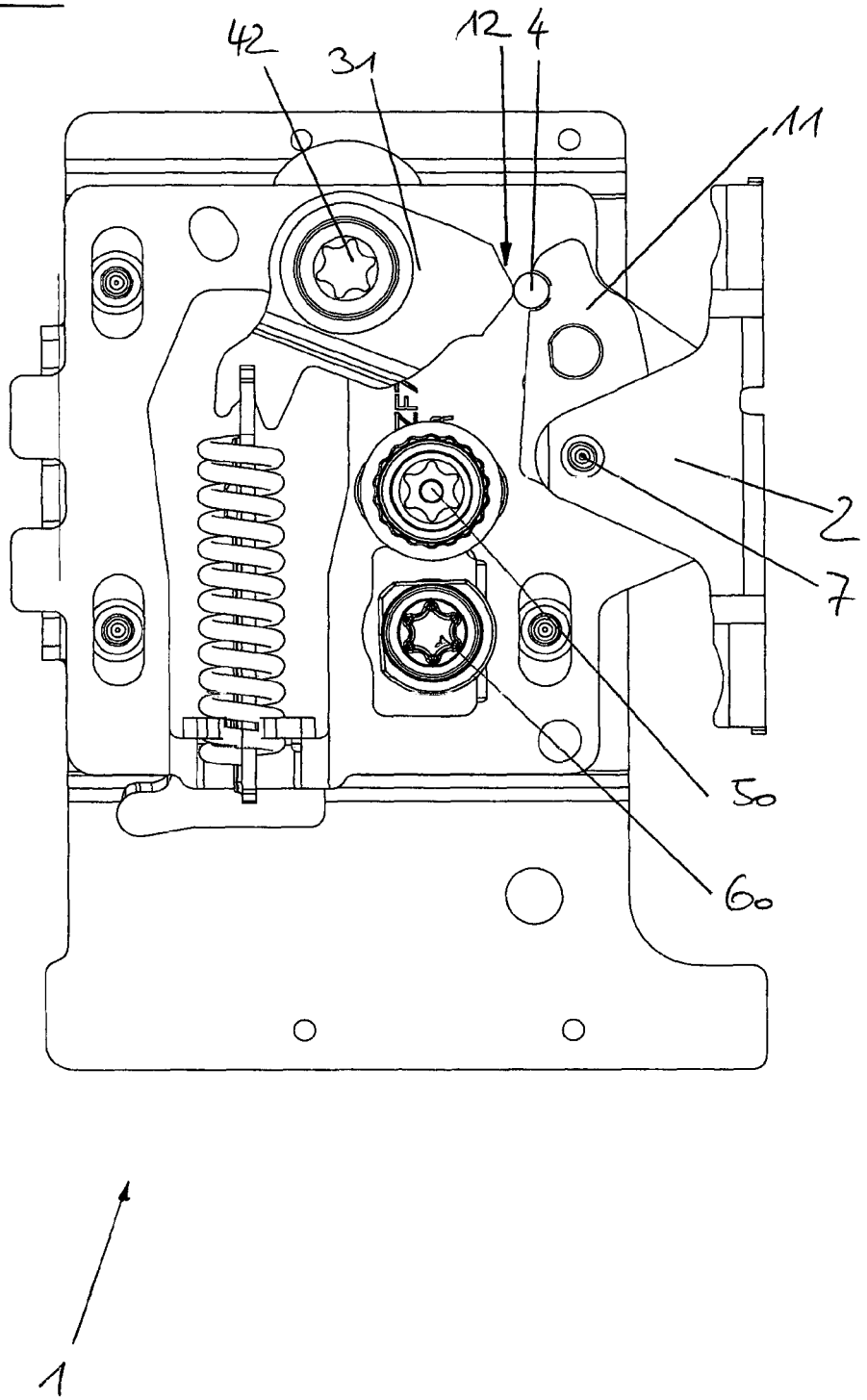
FIG. 10 is a side view of a variant of a fastening device with catching element, pivotal lever, control body and control contour.

FIG. 10 shows a further embodiment of a fastening device 1 having a furniture fitting 2 and its pin 7 arrested in the fastening device 1.

The fastening device 1 once again has the above-mentioned height adjusting device 50 and the lateral adjusting device 60. The pivotal lever 31 again has the tool receiving means 22 for unlocking the fastening device 1.

In this variant, the control contour 12 is provided on the pivotal lever 31 and not on the catching element 11, as in the preceding embodiment. The control contour 12 however also again cooperates with the control body 4 which in this embodiment is on the catching element 11.

That therefore represents the kinematic reversal of the preceding embodiment. The considerations referred to in the preceding specific description correspondingly apply.

LIST OF REFERENCES

1 fastening device
2 furniture fitting

3 guide path
4 control body
5 pressure roller
6 feed path
7 pin
10 catching device
11 catching element
12 control contour
13 receiving means
14 unlocking lever
20 locking device
30 pull-in device
31 pivotal lever
32 spring
33 guide (elongate hole)
34 thrust element
40 unlocking device
41 ejector
42 tool receiving means
43 unlocking element
50 height adjusting device
51 height adjusting screw
60 lateral adjusting device
61 lateral adjusting screw
70 housing
71 right-hand side cover
72 left-hand side cover
73 main plate
100 drawer side wall
101 front panel
102 drawer
103 furniture carcass
104 drawer rear wall
105 drawer extension guide
110 article of furniture
A axis of rotation A of the catching element 11
B axis of rotation B of the pivotal lever 31

The invention claimed is:

1. A fastening device for releasably fastening a front panel to a drawer, said fastening device comprising:

a furniture fitting to be mounted to the front panel;

a catching device associated with the drawer, said catching device being configured to automatically hold said furniture fitting when said furniture fitting is pushed therein, said catching device having a moveable catching element with a control contour;

a locking device for locking said catching device, said locking device being configured to prevent unintentional release of said furniture fitting from said catching device, said locking device having a moveable control body configured to move along a guide path and bear against said control contour of said catching element.

2. The fastening device as set forth in claim 1, wherein said catching element is mounted pivotably about an axis of rotation.

3. The fastening device as set forth in claim 1, wherein said control contour of said catching element is shaped to have different radial spacings relative to an axis of rotation of said catching element.

4. The fastening device as set forth in claim 1, wherein said moveable control body is mounted so as to be displaceable while being guided by said guide path.

5. The fastening device as set forth in claim 1, wherein said control body is formed to have at least one of:

a loose pressure roller construction;

a one-piece construction;

a substantially bolt-shaped construction; and a steel construction.

6. The fastening device as set forth in claim 1, wherein at least part of said guide path has a curved configuration with a decreasing radius.

7. The fastening device as set forth in claim 6, wherein said decreasing radius is a continuously decreasing radius.

8. The fastening device as set forth in claim 1, further comprising a feed path for guiding said furniture fitting, said feed path having a substantially straight configuration, and said locking device being configured to automatically hold said furniture fitting against unintentional release at at least two different positions on said feed path.

9. The fastening device as set forth in claim 8, wherein said locking device is configured to hold said furniture fitting against unintentional release at least region-wise at any position along said feed path.

10. The fastening device as set forth in claim 1, further comprising a pull-in device for pulling said furniture fitting, said pull-in device including a pivotal lever configured to be loaded by a spring so as to displace said moveable control body along said guide path, pivot said catching element, and pull said furniture fitting under a spring loading towards the drawer.

11. The fastening device as set forth in claim 10, further comprising a main plate and a housing, said pivotal lever being mounted rotatably to said main plate, said main plate being stationary relative to said housing.

12. The fastening device as set forth in claim 10, wherein said pivotal lever is configured to be motionally coupled to said catching element by said control body bearing against said control contour.

13. The fastening device as set forth in claim 10, wherein said control body is formed as a pressure roller mounted loosely in said guide path formed as an elongate hole, and said pressure roller is further mounted loosely in a guide formed of an elongate hole, and said pressure roller running against said control contour.

14. The fastening device as set forth in claim 1, further comprising an unlocking device for unlocking said catching device, said unlocking device being configured to permit intentional release of said furniture fitting from said catching device, said unlocking device being configured to lift said control body off said control contour of said catching element and thereby releases said catching element and said furniture fitting.

15. The fastening device as set forth in claim 14, wherein said unlocking device has an ejector for permitting ejection of said furniture fitting after being unlocked, said ejector being configured to pivot said catching element when said catching element is unlocked and thereby repel said furniture fitting from the drawer.

16. The fastening device as set forth in claim 14, wherein said unlocking device has a tool receiving portion for a tool, said tool receiving portion being accessible from an exterior for actuation of at least one of said unlocking device and an ejector for permitting ejection of said furniture fitting after being unlocked.

17. The fastening device as set forth in claim 1, further comprising at least one of a height adjusting device and a lateral adjusting device for adjusting a position of the front panel.

18. A drawer comprising at least one fastening device for releasably fastening a front panel to a drawer, each of said at least one fastening device being configured as set forth in claim 1.

19. An article of furniture comprising said drawer as set forth in claim 18.

* * * * *